US006739780B1

(12) United States Patent
Kuo

(10) Patent No.: US 6,739,780 B1
(45) Date of Patent: May 25, 2004

(54) PEN WITH VARIABLE PENHOLDER STYLES

(76) Inventor: Chin-Yi Kuo, No. 29, Lane 14, Ho Ping Rd., Panchiao City, Taipei Hsien (TW)

( * ) Notice: Subject to any disclaimer, the term of this patent is extended or adjusted under 35 U.S.C. 154(b) by 0 days.

(21) Appl. No.: 10/671,627

(22) Filed: Sep. 29, 2003

(51) Int. Cl.[7] ..... B43K 29/00
(52) U.S. Cl. ..... 401/195; 401/52
(58) Field of Search ..... 401/195, 52, 222, 401/221

(56) References Cited

U.S. PATENT DOCUMENTS 4,983,062 A * 1/1991 Hour ..... 401/195
6,612,766 B2 * 9/2003 Collins ..... 401/88

* cited by examiner

*Primary Examiner*—David J. Walczak
(74) *Attorney, Agent, or Firm*—Bacon & Thomas, PLLC

(57) ABSTRACT

A pen with variable penholder styles having provided at the front section a hollow insertion tube in smaller diameter to contain a refill, multiple decoration rings being inserted onto the peripheral of the insertion tube; surface of the decoration ring being provided with specific color, stripe or pattern; a pen point cover being screwed to the front end of the insertion tube; each and all decoration rings being adjustable as desire and then held tightly together under the compression of the pen point cover to create for the penholder a personal style.

10 Claims, 7 Drawing Sheets

PEN WITH VARIABLE PENHOLDER STYLES

BACKGROUND OF THE INVENTION (a) Field of the Invention

The present invention is related to a pen with variable penholder styles, and more particularly, to one that can be applied to a ball pen, a steel ball pen, an automatic pen, a fountain pen or any other writing tool to allow the arrangement of the style, pattern or collar combination for the penholder as desired.

(b) Description of the Prior Art

A ball pen, steel ball pen or automatic pen generally available in the market is usually comprised of a hollow penholder, a pen clip and at least one refill; and a button one the top of the penholder in case of a mechanical pen. A hollow conic pen point cover is screwed to the upper end of the penholder with the pen point exposed out of the pen point cover.

However, the design for the appearance of the pen is pre-determined making the style of the penholder dull and monotonous, and is difficult to be identified among a bunch of pens. The user would have to bother to mark on the penholders one by one. In a time when people are pursuing demonstration of individual style, pen certainly is included as one of the objects to be given with the style the user thinks most fits for him. The prior art of the penholder fails the needs of the contemporary people.

SUMMARY OF THE INVENTION

The primary purpose of the present invention is to provide a pen with variable penholder styles, particularly on the innovative improvement for the penholder, which allows its user to arrange the style, color, or pattern of penholder as desired, and further to make the pen easier to identify while maintaining the effect of personal style To achieve the purpose, the front of the penholder is made a hollow insertion tube in smaller diameter to accommodate a refill. Multiple decoration rings are inserted on the peripheral of the insertion tube of the penholder. Multiple grains and pits are respectively provided at the front and the rear end of each decoration ring to allow each ring to be turned around for adjustment or positioning. A special color, strip or pattern is provided on the circumferential surface of each ring. A pen point cover is screwed to the front end of the insertion tube and those multiple decoration rings are locked to one other by means of those grains and pits provided to each decoration ring under the compression of the pen point cover to demonstrate a pen holder with personal character from the combination of style, pattern or color as one chooses.

Another purpose of the present invention is to provide a pen with variable penholder styles that satisfy the demonstration of personal style and permit easy identification. To achieve the purpose, multiple troughs are provided on the peripheral of each decoration ring and each trough is planted in a silicon ornament piece to allow the user to decorate the penholder with different styles of ornament piece as desired and the overall appearance of pattern or letter can be adjusted by turning the rings whenever one feel likes to.

Another purpose yet of the present invention is to provide a pen with variable penholder styles that allows wide range of combination of the ornament pieces. To achieve the purpose, any letter, pattern, stripe or color can be provided on the surface of the ornament piece.

DETAILED DESCRIPTION OF THE PREFERRED EMBODIMENTS

Figure 1:
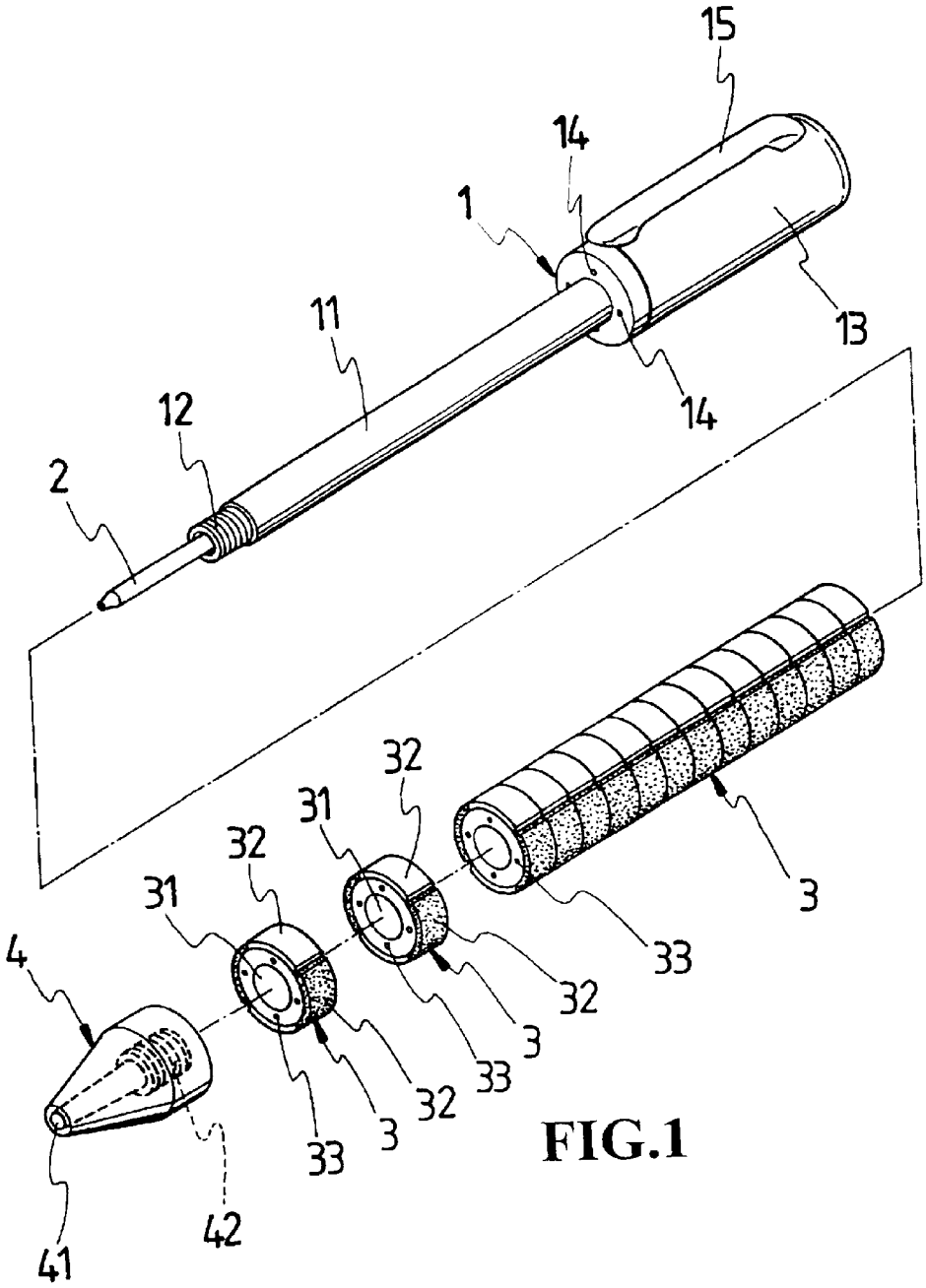
FIG. 1 is an exploded view of a local part of a pen of the present invention.
Figure 2:
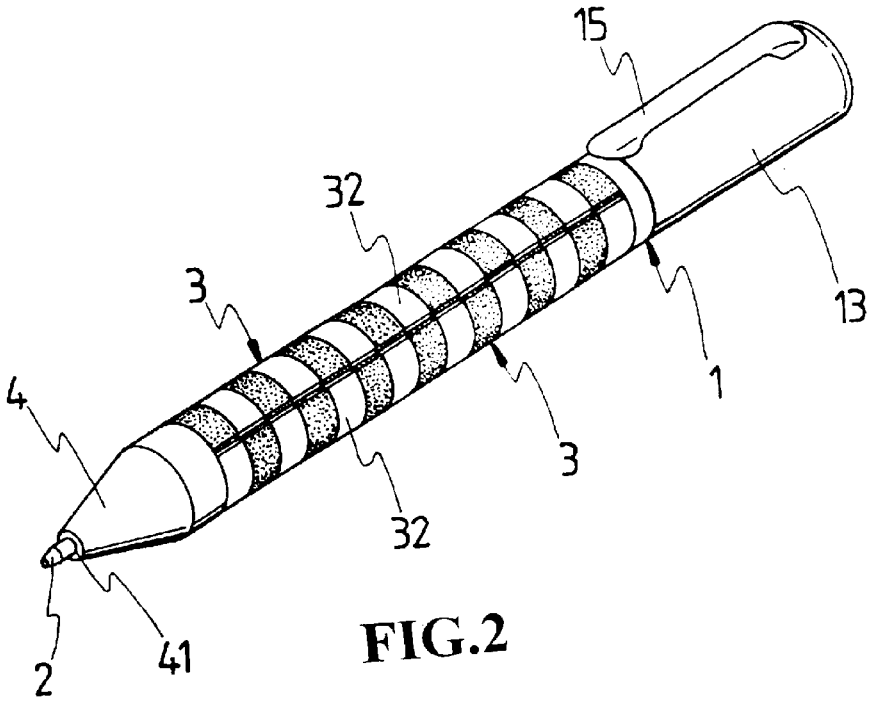
FIG. 2 is a perspective view showing the pen of the present invention as assembled.
Figure 3:
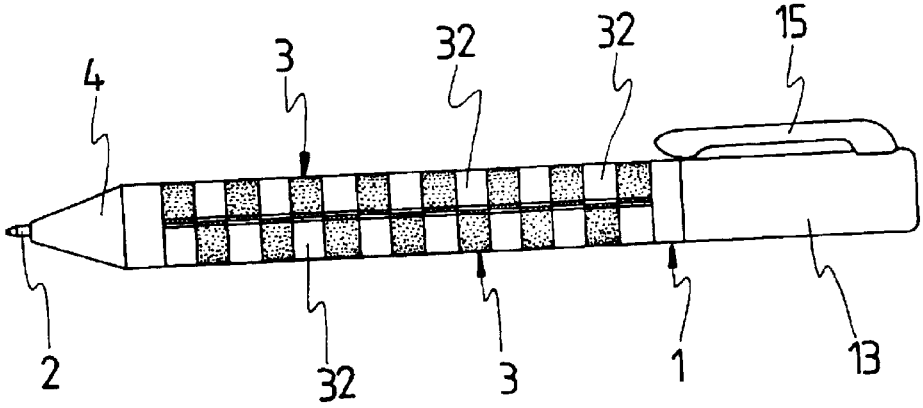
FIG. 3 is front view of the pen of the present invention as assembled.

Referring to FIGS. 1, 2, and 3, a pen with variable penholder styles of the present invention is essentially comprised of a penholder 1, a refill 2, multiple decoration rings 3 and a pen point cover 4. Wherein, the penholder 1 as illustrated in FIG. 1 relates to a hollow tube having provided at its front section a hollow insertion tube 11 in smaller diameter that that of the remaining part of the penholder 1. A threaded section 12 is provided at the front end of the insertion tube 11, an upper section 13 of the penholder in larger diameter is connected to the rear of the insertion tube 11, and multiple pits 14 are provided at equal distance on the front end surface of the upper section 13 of the penholder. In the present invention, the penholder 1 is provided to accommodate elements of the refill 2, those decoration rings 3, and the pen point cover 4 by the insertion tube 11. However, other preferred embodiments of the present invention may further include a pen clip 15, or have the penholder 1 made with a fixed refill, or a retractable refill by twisting or by compression.

The refill 2 as illustrated in FIG. 1 contains the ink or pencil lead and is placed into the hollow insertion tube 11 of the penholder 1 with the pen point exposed out of the front end of the insertion tube 11. However, the refill 2 may be related to that for a ball pen, a steel ball pen, automatic pencil lead or any other type of refill. All these refills are of the prior art and will not be elaborated herein.

The decoration ring 3 as illustrated in FIG. 1 relates to a circular ring having at its center provided with an opening 31 and multiple ornament pieces 32 on the circumferential surface. Multiple pits 33 are provided on one end surface of the decoration ring 3 and multiple evenly distributed grains 34 to match those pits 33 are provided on the other end surface. The surface of each ornament piece 32 is provided with color, pattern, letter, stripe or other graphic design either by printing, coating or engraving method so that when multiple decoration rings 3 are abutted to one another, variable appearances are created on the penholder 1.

The pen point cover 4 as illustrated in FIG. 1 relates to a conic hollow object having at its center provided with a through hole 41 to permit the exposure of the refill 2 out of the front end of the insertion tube 11. Multiple decoration rings 3 are inserted side by side in the same direction onto the peripheral of the insertion tube 11 with the pen point cover 4 having its threaded section 42 at the rear to be engaged with the threaded section 12 at the front end of the insertion tube 11, and the tip of the refill 2 exposed out of the front end of the insertion tube 11. Upon loosening the pen point cover 4, any of those decoration rings 3 can be turned around to change for another style for the appearance of the penholder 1 while upon tightening up the pen point cover 4, all those decoration rings 3 are packed to hold steady the style of the penholder 1.

Figure 4:
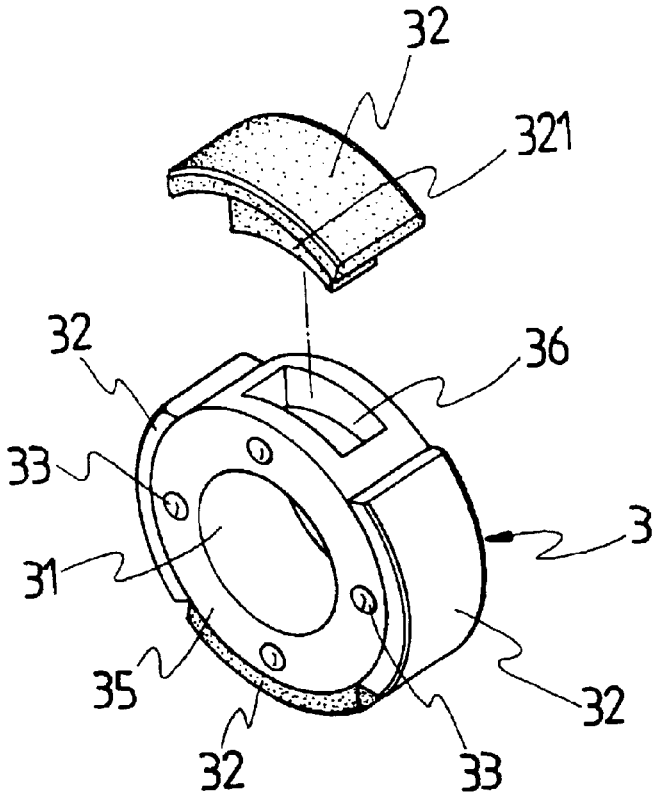
FIG. 4 is an exploded view of a local part of a preferred embodiment of a decoration ring of the present invention.
Figure 5:
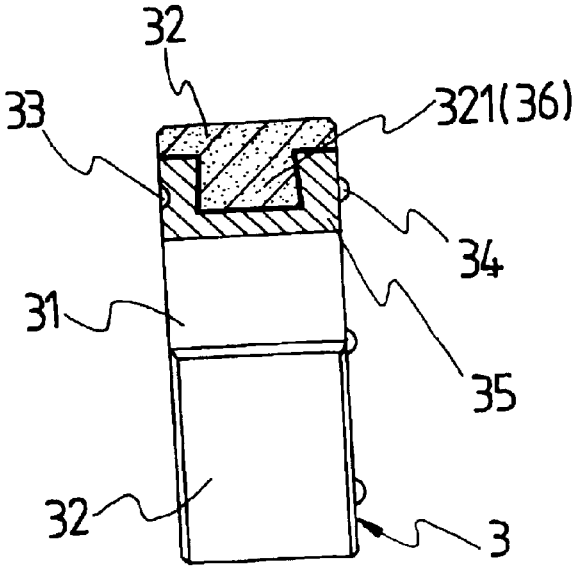
FIG. 5 is a schematic view showing the preferred embodiment of the decoration ring of the present invention as assembled.
Figure 6:
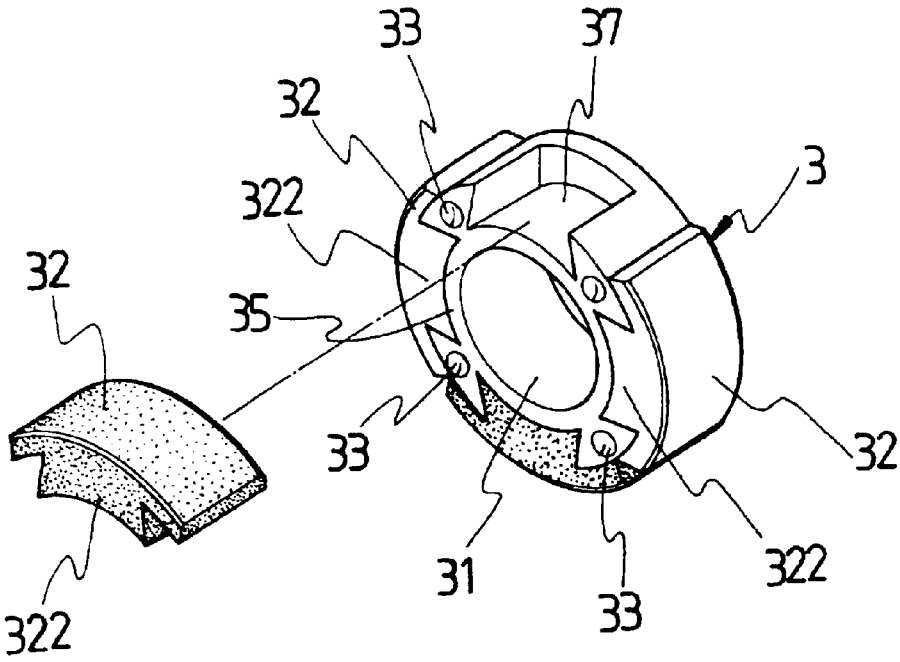
FIG. 6 is an exploded view of a local part of another preferred embodiment of a decoration ring of the present invention.
Figure 7:
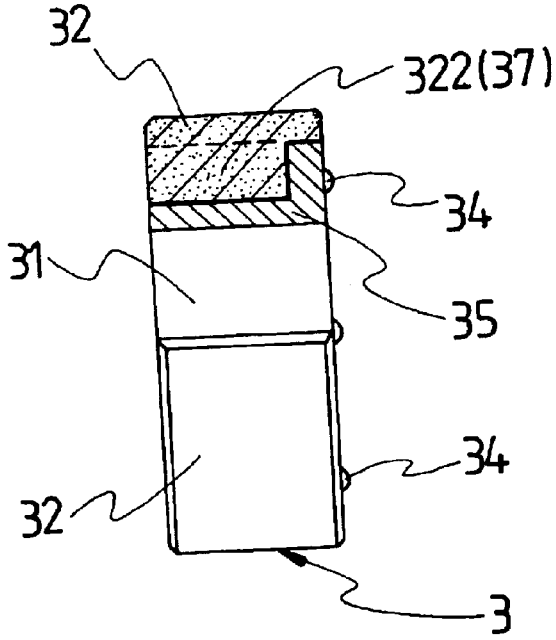
FIG. 7 is a schematic view showing another preferred embodiment of the decoration ring of the present invention as assembled.
Figure 8:
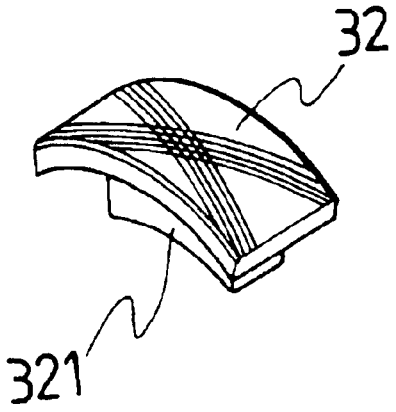
FIG. 8 is a schematic view showing that stripes are provided on the surface of an ornament piece of the present invention.
Figure 9:
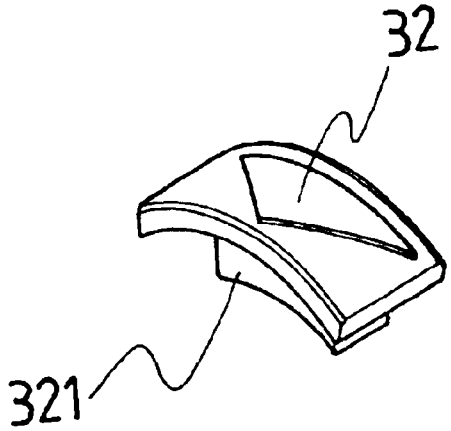
FIG. 9 is a schematic view showing that a pattern is provided on the surface of an ornament piece of the present invention.

As illustrated in FIGS. 4 and 5, each decoration ring 3 is related to a circular ring 35 having at its center provided with an opening 31, multiple pits 33 being evenly provided on one end surface and multiple corresponding grains 34 being provided on the other end surface of the decoration ring 3. Furthermore, multiple troughs 36 having wider interior and narrower exterior are provided on the circumferential surface of the decoration ring 3 to be respectively planted an arc ornament piece 32 provided with an insertion bit 321 at the bottom. Now referring to FIGS. 6 and 7, a decoration ring 3 of the present invention is related to a circular ring 35 having at its center provided with an opening 31, and multiple dovetail grooves 37 being evenly distributed on one end surface to respectively receive their corresponding arc ornament pieces 32 each provided with at its bottom a dovetail tongue 332. However, the ornament piece 32 may be made of rubber, silicone, plastic or other material in once piece and either printed, coated or engraved upon its surface any color, letter, stripe as illustrated in FIG. 8 or pattern as illustrated in FIG. 9. Once multiple decoration rings 3 are abutted and inserted onto the peripheral of the insertion tube 11, creating an appearance in special style by the color, letter, stripe, or pattern for the penholder 1. Furthermore, to suit personal like and improve the identity of the pen, those multiple decoration rings 3 may be turned around or replaced with other types of ornament pieces 32 for demonstrating other styles as desired.

Figure 10:
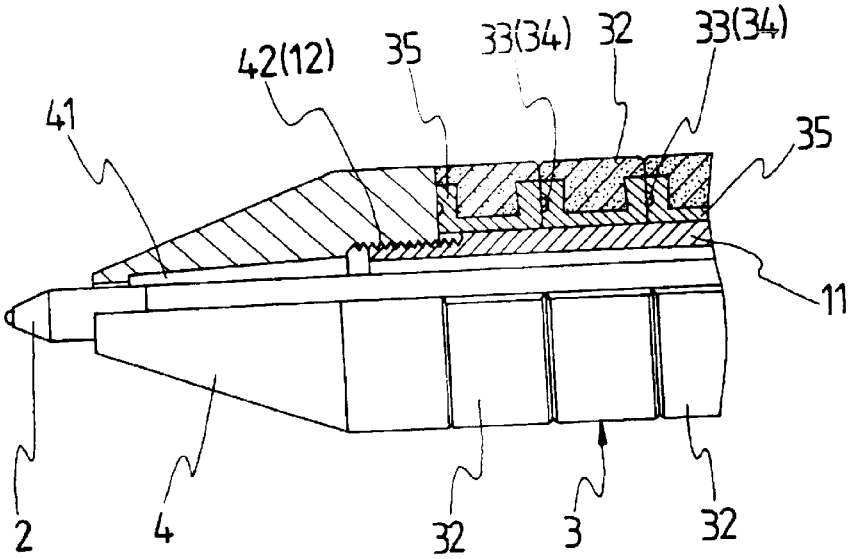
FIG. 10 is a schematic view that those multiple decoration rings of the present invention are incorporated to one another under compression.
Figure 11:
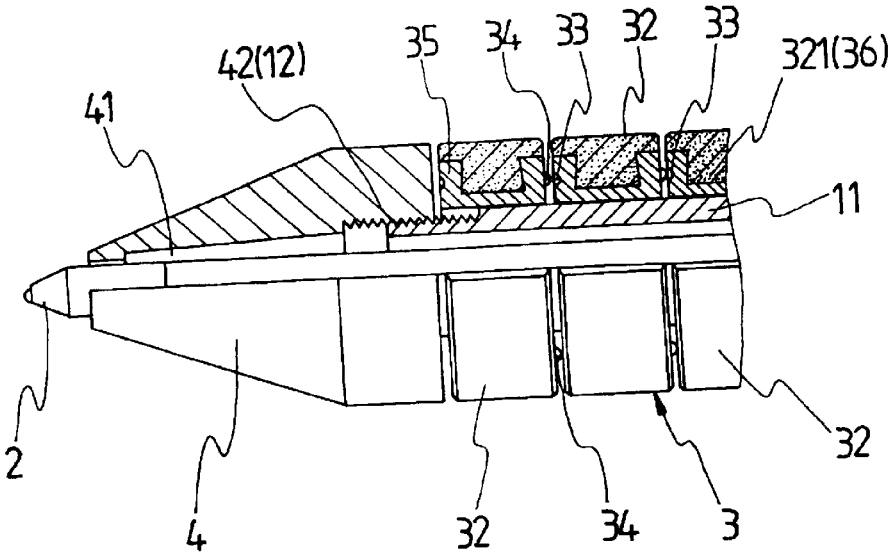
FIG. 11 is a schematic view showing that a pen point cover of the present invention is in loosening status.

Referring to FIG. 11 for the adjustment modes by turning around each decoration ring 3, the pen point cover 4 is loosened first to permit slight spacing between two abutted decoration rings 3 while those grains 34 on one end of a decoration ring 3 are disengaged from those pits 33 from another decoration ring 3. By turning around any decoration ring 3 or multiple decoration rings 3, effects of color, letter and pattern are displayed according to personal favors. Upon completing the adjustment, tighten up the pen point cover 4 again to compress all the decoration rings 3 to abut to one another as illustrated in FIG. 10 with those grains 34 to be engaged to their respective pits 33 on the other decoration ring 3, thus to secure the color, letter, or pattern as adjusted.

Figure 12:
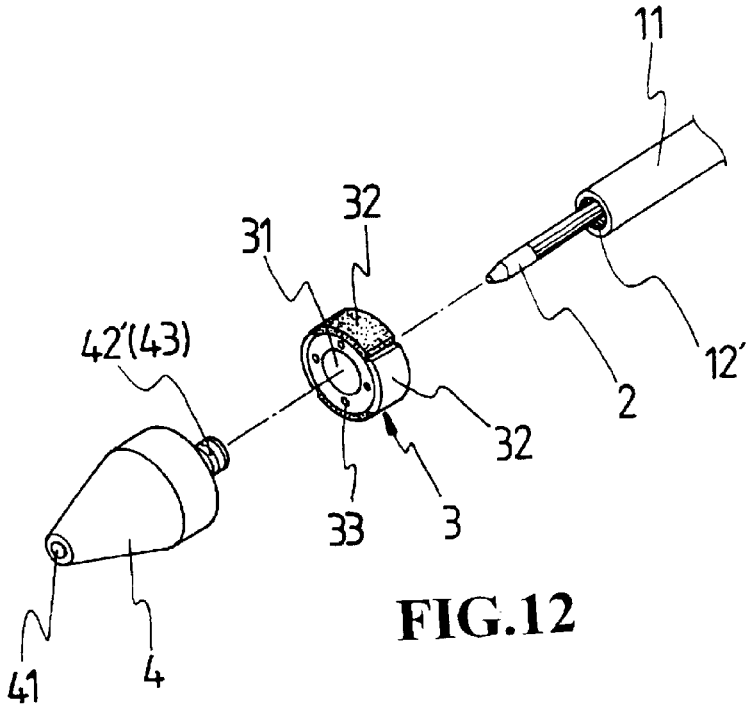
FIG. 12 is an exploded view of another yet preferred embodiment of the present invention showing a structure of the pen point cover is screwed to an insertion tube.
Figure 13:
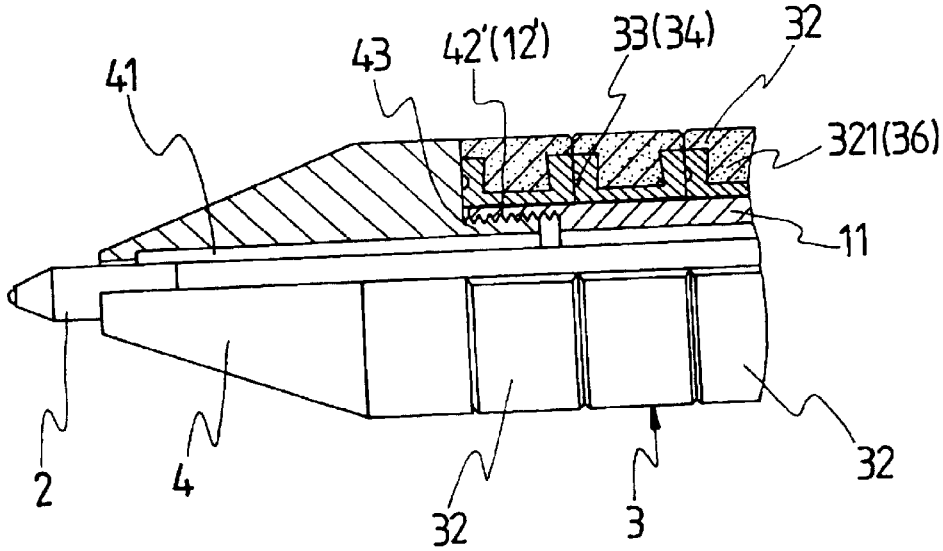
FIG. 13 is a schematic view of another yet preferred embodiment of the present invention showing a structure of the pen point cover is screwed to an insertion tube as assembled.

The threaded section 12 at the front end of the insertion tube 11 is provided for engaging to another threaded section 42 provided at the rear end of the pen point cover 4 as illustrated in FIGS. 1 and 10. In practice, an externally threaded section 12 is provided to the peripheral of the front end of the insertion tube 11 and an internally threaded section 42 is provided in the hole at the rear end of the pen point cover 4 for fastening the insertion tube 11 to the pen point cover 4. However, as illustrated in FIGS. 12 and 13, the same fastening effect is also achieved by having an internally threaded section 12' provided on the inner wall of the hole at the front end of the insertion tube 1, a protruded shaft 43 provided at the rear end of the pen point cover 4, and an externally threaded section 42' provided to the peripheral of the protruded shaft 43.

It should be noted that the pen of the present invention comprised of the penholder 1, the refill 2, multiple decoration rings 3 and a pen point cover 4 may be applied to a ball pen, a steel ball pen, an automatic pen or any other type of pen simply by replacing the refill 2; and the preferred embodiment of the present invention also include the structure of a fixed refill, and a retractable refill either by twisting or compressing. Whereas all these preferred embodiments are related to the prior art and incorporated into the characteristics of the present invention as described above, the preferred embodiments of the present invention certainly are not limit to those disclosed herein.

What is claimed is:

1. A pen with variable penholder styles comprised of a penholder related to a hollow tube, having provided at the front section a hollow insertion tube in smaller diameter, and a threaded section being provided at the front end of the insertion tube; a refill, containing ink or pencil lead for writing purpose being inserted into the insertion tube of the penholder; multiple decoration rings each related to a circular ring, multiple ornament pieces giving various appearance effects being provided on the circumferential surface of said rings, multiple pits being provided on one end surface of said rings, and multiple corresponding grains being provided on the other end surface of said rings; and a pen point cover related to a conic hollow object, having provided at its center a through hole, the refill being exposed out of the through hole; and a threaded section being provided at the rear end of the pen point cover is characterized by that multiple selected decoration rings being inserted side by side in the same direction onto the insertion tube; the pen point cover being fastened with its threaded section to that threaded section provided on the insertion tube; any and all decoration rings being turned around to change the style of the appearance of the penholder as desired when the pen point cover being loosened up; and all decoration rings being packed to hold steady its style when the pen point cover being tightened up.

2. A pen with variable penholder styles as claimed in claim 1, wherein, the decoration ring include, an multiple insertion troughs each with wider interior and narrow exterior being provided on the circumferential surface; and said multiple ornament pieces each in arc and provided at its bottom an insertion bit being respectively inserted to their respective troughs.

3. A pen with variable penholder styles as claimed in claim 2, wherein, the ornament pieces are made of silicone in one piece and color, letter, stripe or pattern is printed, coated or engraved on the surface of the ornament piece.

4. A pen with variable penholder styles as claimed in claim 1, wherein, the decoration ring include multiple dovetail grooves being evenly distributed on the surface; and said multiple ornament pieces each in arc and having at its bottom provided with a dovetail tongue being respectively planted into their corresponding dovetail grooves.

5. A pen with variable penholder styles as claimed in claim 4, wherein, the ornament pieces are made of silicone in one piece and color, letter, stripe or pattern is printed, coated or engraved on the surface of the ornament piece.

6. A pen with variable penholder styles as claimed in claim 1, wherein, the ornament pieces are printed, coated or engraved on its surface a color, letter, stripe or pattern.

7. A pen with variable penholder styles as claimed in claim 1, wherein, the rear section of the insertion tube is connected to an upper section in larger diameter of the penholder, and multiple pits corresponding to those grains on their respective decoration rings are provided at the front end of the upper section of the penholder.

8. A pen with variable penholder styles as claimed in claim 1, wherein, the threaded section at the front end of the insertion tube is related to an externally threaded section provided on the peripheral of the front end of the insertion tube; and the threaded section at the rear end of the pen point cover is related to an internally threaded section provided on the inner wall of the hole for the insertion tube to be fastened to the pen point cover.

9. A pen with variable penholder styles as claimed in claim 1, wherein, the threaded section at the front end of the insertion tube is related to an internally threaded section provided on the inner wall of the hole; and a protruded shaft is provided at the rear end of the pen point cover; an externally threaded section is provided to the peripheral of the protruded shaft for the insertion tube to be fastened to the pen point cover.

10. A pen with variable penholder styles as claimed in claim 1, wherein, the refill is related to that for a ball pen, a steel ball pen or an automatic pencil.

* * * * *